United States Patent [19]

East

[11] Patent Number: 4,760,656

[45] Date of Patent: Aug. 2, 1988

[54] PLACER MINING APPARATUS WITH PUDDLING NOZZLE

[76] Inventor: Vernoy A. East, 915 W. 16th St., Tempe, Ariz. 85281

[21] Appl. No.: 84,436

[22] Filed: Aug. 11, 1987

[51] Int. Cl.[4] ..... E02F 3/88

[52] U.S. Cl. ..... 37/57; 37/62; 251/315

[58] Field of Search ..... 37/61–63, 37/78, 58, 57; 251/315

[56] References Cited

U.S. PATENT DOCUMENTS

| | | | |
|---|---|---|---|
| 1,518,528 | 12/1924 | Libby | 37/62 |
| 1,653,027 | 12/1927 | Ward | 37/62 |
| 2,774,569 | 12/1956 | Jacobsen | 37/63 |
| 2,895,710 | 7/1959 | Sanctuary | 251/315 X |
| 2,960,368 | 11/1960 | Watanabe | 37/62 |
| 4,352,251 | 10/1982 | Sloan | 37/58 |

*Primary Examiner*—Clifford D. Crowder

*Attorney, Agent, or Firm*—Herbert E. Haynes, Jr.

[57] ABSTRACT

A placer mining apparatus for intaking a slurry of water and ore bearing soils and directing the slurry to an ore separating mechanism is provided with a suction nozzle for intaking slurry and an integral puddling nozzle for selectively supplying water to produce the slurry in a dry area. A digging structure is provided at the intake end of the suction nozzle for loosening and/or burrowing into the soil.

3 Claims, 1 Drawing Sheet

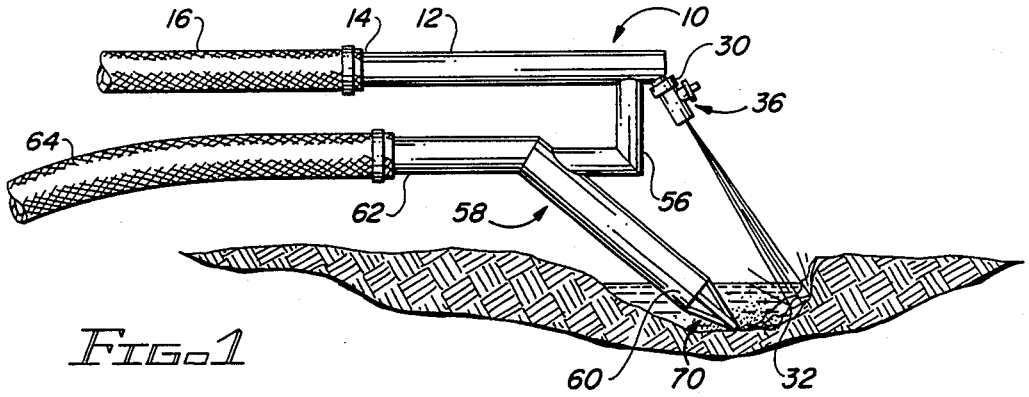
FIG. 1
FIG. 2
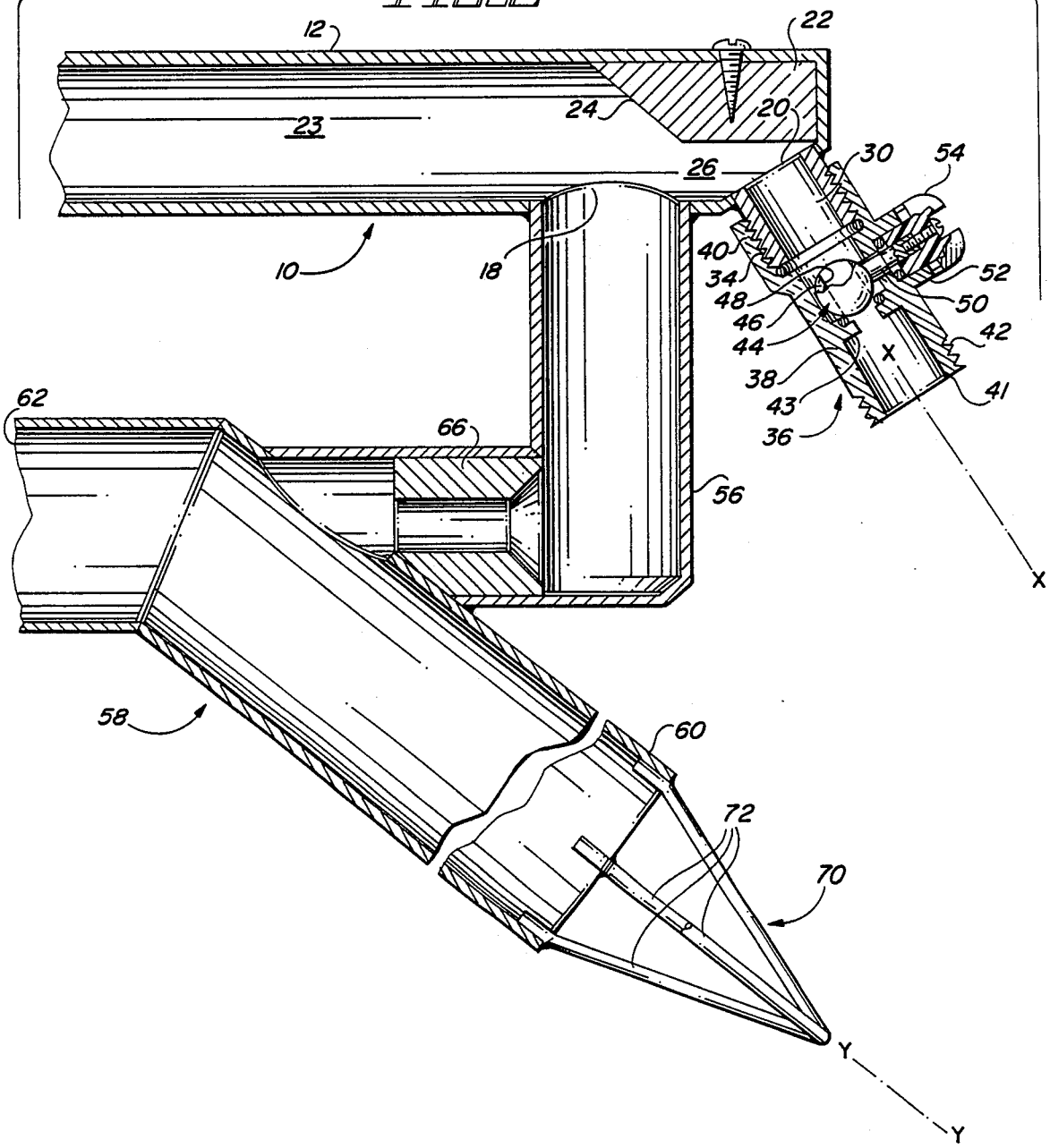

PLACER MINING APPARATUS WITH PUDDLING NOZZLE

BACKGROUND OF THE INVENTION

1. Field of the Invention

This invention relates generally to placer mining equipment and more particularly to an apparatus including a suction nozzle for extracting and a moving an ore bearing slurry to an ore separating device and selectively operable puddling nozzle for directing slurry producing water to an otherwise dry area to be mined.

2. Description of the Prior Art

As is known, placer mining is a technique used for extracting ores, such as gold, from river beds and other water bodies. A slurry mixture of water and ore bearing soil is extracted from the river bed and placed in a ore separating apparatus, such as a sluice box. The sluice box is operated to separate the ore from the soil and water.

In relatively sophisticated placer mining operations, a high pressure water pump extracts water from the river bed and directs it to a suction nozzle which extracts the ore bearing soil in slurry form from the river bed and delivers it to the sluice box.

One indispensable commodity needed for placer mining operations is water, without it, placer type mining operations are impossible. In sites where river beds have changed course, are of reduced width, or have dried up completely, many desirable mining sites are left unmined due to the lack of water.

One way of overcoming the problem of a lack of water at a mining site where it is desirable to utilize placer mining techniques is, of course, to transport water to the site and dump it into the area to be mined. This is impractical due to the tendency for water to spread out and rapidly sink into the dry ground. In that the water must be transported to the mining site, it is imperative that the water be conserved and used as efficiently as possible. To the best of my knowledge, no mechanism or technique has been devised or suggested which accomplishes the objectives of water conservation and efficient use of the water transported to dry mining sites for use in accomplishing placer type mining.

I am however, aware of a hydraulic conveyer apparatus which is disclosed in U.S. Pat. No. 1,518,528, which issued to H. T. Libby on Dec. 9, 1924. The Libby apparatus includes a water supply line which directs water under pressure from a remote source to a T-junction having a pair of hand-operated valves each at a different one of the outlets of the T-junction. A first elongated hose is coupled to one of the T-junction outlets and a washing nozzle is mounted on the distal end of that first hose for driving dirt and rocks into a previously dug hole and subsequently enlarging the hole to uncover a subterranean hard rock layer that is to be quarried. A second hose is coupled to the other outlet of the T-junction and has a conventional hose nozzle on its distal end which is mounted by a special screen structure so that the nozzle is axially disposed in the intake end of a waste material conveyer pipe to provide a suction at the inlet of the pipe. The hose nozzle, screen structure and intake end of the conveyer pipe are disposed in the previously dug hole, and operate to carry away the driven dirt and rocks along with the water from the washing nozzle. While the apparatus of the Libby patent could be used for placer mining, it has several drawbacks which make it unsuited and impractical for such use. The first drawback of the Libby structure must be of a relatively high volume and pressure in order to accomplish the objective of driving the dirt and rocks, and such volume and pressure are considerably greater than is needed for placer mining. Further, since the water emitted from the washing nozzle is at a variable distance from the intake end of the conveyer pipe, the water will tend to sink into the ground and be lost. This is not a problem with the Libby apparatus in that it is operating on a quarry bed which has little or no porosity. However, this is usually not the case in placer mining sites. The second drawback of the Libby structure is related to its lack of mobility as is needed, or at least highly desirable in placer mining. Placer mining is usually accomplished by one person who carries a suction nozzle from one place to another at the mining site, and this requires the use of an easily handled portable suction nozzle which can, in addition to its material carrying capabilities, be used to burrow into the ground. The Libby apparatus is totally unsuitable for this type of use in that it cannot be easily carried by one person from place to place and operated while being held by that person. Further, the suction end of the materials conveyer pipe of the Libby apparatus is obstructed by the hose nozzle and screen structure and thus cannot be used to accomplish burrowing operations as needed in placer mining, but must, instead by used in a pre-existing depression or hole dug for that purpose.

Another problem with the Libby apparatus is that because the elevation of the discharge end of the waste conveyer pipe with respect to its intake end will vary depending on the depth of the depression, it is necessary to control the pressure of the water delivered to the injector nozzle; i.e. for a deep depression, the pressure must be increased, and for a shallow depression, it should be decreased. Thus, the Libby apparatus is provided with two separate flow control valves: one for controlling the flow of water to the washing nozzle mechanism, and one for controlling the flow of water to the injection nozzle. The two valve structure is expensive to manufacture, and does not allow for convenient one handed operation.

Therefore, a need exists for a new and useful placer mining suction nozzle having a puddling means which allows the use of placer mining techniques in dry areas and which overcomes some of the difficulties and shortcomings of the prior art.

SUMMARY OF THE INVENTION

In accordance with the present invention, a new and useful lightweight portable placer mining apparatus including a suction nozzle and an integral puddling nozzle means is disclosed which allows one person to carry and operate the apparatus for accomplishing placer type mining in the usual places where such mining is accomplished, such as a river bed, and may also be used for placer type mining in dry areas. A digging or burrowing structure is provided at the inlet end of the suction nozzle for loosening and/or boring into packed soil and the like at the bottom or sides of the river bed or other such area. The placer mining apparatus is designed for use with a high pressure pump and a conventional mineral separating structure, such as a sluice box.

When used to accomplish placer mining in a river bed or other body of water, the apparatus is used in a conventional manner. Water in the river bed is directed to the suction nozzle portion of the apparatus by the high pressure pump and is injected through a venturi structure into the suction nozzle. This creates a partial vacuum at the slurry inlet end of the suction nozzle causing it to pick up a slurry consisting of water and ore bearing soil from the river bottom. The slurry moves through the suction nozzle and a suitable hose to the sluice box for conventional ore separation.

When used in dry areas, water from a remote river bed, lake or the like, or from a water supply transported to the mining site for this purpose, is directed by the pump into the apparatus, and the puddling nozzle means of the apparatus of the present invention is operable to supply water to the otherwise dry area. Manually operable control means are provided on the puddling nozzle for switching the puddling nozzle from a bypass mode, in which the suction nozzle operates to intake and move the slurry, to an operating mode which allows an operator to introduce water into a dry area proximate the intake end of the suction nozzle to create a slurry which is subsequently picked-up by the suction nozzle for delivery to the ore separating device. In dry mining sites where a water supply is reasonably close, the pump can be operated to extract water from that supply and return it as normally done in placer mining operations. In cases where the water supply is transported to the mining site, the water may be recycled.

The puddling nozzle means in its operating mode diverts some of the water which is normally supplied by the pump to the suction nozzle portion of the apparatus and expels the diverted water at high pressure and high velocity through the puddling nozzle into the dry area proximate the intake end of the suction nozzle. In this way, the operator can selectively create a slurry in the otherwise dry area. In addition, if the soil in the dry area is tightly packed, the operator can loosen it prior to or during the placer mining operation simply by burrowing into it using the digging structure at the intake end of the suction nozzle. As mentioned above, the puddling nozzle is manually operable, and the manual operation is accomplished in a way which allows an operator to adjustably control the flow of diverted water through the puddling nozzle.

In the bypass mode of the puddling nozzle means, the water directed to the apparatus by the pump will simply bypass the puddling nozzle on its way to the suction nozzle to allow the suction nozzle to pick-up the slurry and move it to the ore separating mechanism in the manner described above. Because the puddling nozzle diverts only a portion of the water delivered by the pump when in its operating mode, both the slurry producing and slurry intake operations can be accomplished simultaneously.

In addition to producing a slurry in an otherwise dry area, the puddling nozzle can be used in other ways to facilitate and enhance placer mining operations. For example, an operator can direct the high pressure and high velocity output water from the puddling nozzle into a river bank to loosen the soil so that gravity and water flow will wash it into the river bed to allow it to be picked-up by normal placer mining techniques.

Accordingly, it is an object of the invention to provide a new and useful portable and easily operated placer mining apparatus including a suction nozzle with an integral puddling nozzle means which allows the use of placer mining techniques in dry areas.

Another object of the invention is to provide a new and useful placer mining suction nozzle with digging means at the inlet end thereof for loosening and/or boring into packed soil and the like.

Still another object of the present invention is to provide a new and useful puddling nozzle as an integral part of a placer mining suction nozzle, with the puddling nozzle having manually operable control means which allows an operator to selectively direct a controllable amount of high pressure and high velocity water into an otherwise dry area proximate the intake end of the suction nozzle to produce a slurry for subsequent pick-up by the suction nozzle.

The foregoing and other objects of the present invention, as well as the invention itself, may be more fully understood from the following description when read in conjunction with the accompanying drawings.

BRIEF DESCRIPTION OF THE DRAWINGS

FIG. 1 shows the apparatus of the present invention being used in a placer mining operation in a dry area such as a dehydrated river bed.

FIG. 2 is an enlarged fragmentary sectional view of the placer mining apparatus of FIG. 1.

DESCRIPTION OF THE PREFERRED EMBODIMENT

Referring more particularly to the drawings, FIG. 1 shows the placer mining apparatus of the present invention, which is indicated generally by the reference numeral 10. The apparatus 10 is used in conjunction with conventional placer mining equipment including a pump (not shown) and an ore separating structure such as a sluice box (also not shown).

The apparatus 10 includes a rigid water inlet conduit 12 having a water intake end 14 connected to a flexible hose 16 which supplies water under pressure to the apparatus 10 from the aforementioned pump (not shown). A first outlet port 18 and a second outlet port 20 are provided at the other end of the inlet conduit 12. A deflection member 22 is mounted in the bore 23 of the inlet conduit 12 in a spaced facing position relative to the water intake end 14. The deflection member 22 includes a guide surface 24 disposed in an angular attitude so that incoming water from the inlet hose 16 will impinge on the guide surface 24 and be directed toward the first outlet port 18. A relief area 26 is provided beneath the deflection member so that the bore 23 of the inlet conduit 12 is open to the second outlet port 20 as well as the first outlet port 18.

A puddling nozzle 30 is welded or otherwise mounted in the second outlet port 20 of the inlet conduit 12 of the placer mining apparatus 10. The puddling nozzle is preferably cylindrical in configuration and defines a longitudinal axis x—x disposed at an angle to the bore 23 of the inlet conduit 12 so as to direct slurry producing water downwardly and forwardly towards the targeted ore bearing soil area 32.

In addition, attachment means such as the illustrated screw threads 34 are provided on the puddling nozzle 30 for demountably carrying a suitable manually operable control means 36 for switching the puddling nozzle 30 from a bypass mode to an operating mode as will hereinafter be described in detail.

Preferably, the control means 36 comprises a tubular housing 38 having an internally threaded inlet end 40 for engaging the external screw threads 34 of the puddling nozzle 30. The outlet end 41 of the control means 36 may also be provided with screw threads 42 or the like for attachment of accessories thereto such as a hose (not shown). An annular flange 43 is formed in the inner central portion of the housing 38, serving as a valve seat for a ball valve 44. The ball valve 44 comprises a rotatable, spherical ball member 46 having a bore 48 formed therethrough. A stem 50 provided on the ball member 46 projects through a boss 52 on the outside of the tubular housing 38. A manually operable knob member 54 is suitably attached to the distal end of the stem 50 and is rotatable therewith. By simply turning this knob 54 an angle of 90°, the operator can switch the device 10 from the illustrated operating mode, in which the bore 48 through the ball member 44 is aligned with the longitudinal axis x—x of the puddling nozzle 30, allowing slurry producing water to be ejected therethrough at a full flow rate, to a bypass mode (not shown), in which the bore 48 is perpendicular to the axis x—x, so that no water will be ejected. The knob 54 may also be turned to any desired intermediate position so as to allow water to be ejected at an intermediate flow rate.

If desired, one or more alternative control means such as a simple screw cap (not shown), a valved hose (not shown), or the like may be provided for interchanging with the illustrated demountable control means 36, in order to adapt the apparatus 10 to various different applications in the placer mining field.

When the puddling nozzle 30 is in its bypass mode, all of the water received in the bore 23 of the inlet conduit 12 of the apparatus 10 will flow therefrom through the first outlet port 18 thereof into an injector conduit 56 which has one of its ends welded or otherwise connected to the first outlet port 18. The opposite end of the injector conduit 56 is similarly attached to a suction nozzle 58. The suction nozzle 58 is provided with a slurry inlet, or suction end 60 and an outlet end 62 which is connected to a flexible hose 64 which delivers the slurry to an ore separating structure such as a sluice box for processing. As shown, the slurry inlet end 60 of the suction nozzle 58 is disposed at an acute angle with respect to the injector conduit 56 and defines a longitudinal axis y—y which converges with the longitudinal axis x—x of the puddling nozzle 30, while the outlet end 62 of the suction nozzle 58 is axially aligned with the injector conduit. A venturi restrictor 66 is located in the injector conduit 56 proximate the end thereof which opens into the suction nozzle. Therefore, in accordance with Bernoulli's Principle, the water flowing through the venturi restrictor 66 will produce a low pressure within the suction end 60 of the nozzle 58 for slurry intaking purposes.

A digging or burrowing structure 70 is provided at the inlet end 60 of the suction nozzle 58 for loosening and/or boring into the soil of the area being mined. Preferably, the digging structure 70 comprises a set of four rods 72 arranged at diametrically opposite locations at the end of the suction nozzle 58, and which converge toward one another to form a point. The digging structure 70 also serves as a non-clogging screen tip which prevents large chunks of stone and the like from entering the suction nozzle 58.

Operation of the placer mining apparatus 10 will be obvious from the above detailed description. However, to insure a complete understanding of its various capabilities, a brief operational description will now be presented.

A user of the apparatus 10 holds it by the water inlet conduit 12, which serves as a handle, and carries the apparatus 10 to the dry site to be mined. By aiming the puddling nozzle 30 toward the desired location 32, and adjusting the control means 36 so that the puddling nozzle is in its operating mode, a portion of the water in the inlet conduit 12 will be ejected at high pressure and velocity to loosen the soil and produce a puddle in the area to be mined. If the soil is very tightly packed, it may be desirable to augment the soil loosening capability of the puddling nozzle by gouging or burrowing into the soil with the pointed digging structure 70 at the end of the suction nozzle 58. Once a puddle has been produced in this manner, or simultaneously with the production of a puddle, the user can lower the suction end 60 of the nozzle into the puddle and thereby commence intaking of the slurry. Because the control means 36 allows only a portion of the received water to be ejected through the puddling nozzle 30, it will be seen that both the puddling and suction operations can be carried out simultaneously.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

I claim as my invention:

1. A hand-held placer mining apparatus for picking up and delivering a slurry of water and ore bearing soils to an ore separating structure and for selectively supplying water to produce the slurry in dry areas, said apparatus comprising:

(a) a water inlet conduit defining a bore and having an intake end for receiving pressurized water from a remote source, said water inlet conduit defining a first outlet port and a second outlet port at spaced apart locations opposite the intake end thereof;

(b) an injector conduit defining a bore and having one end integrally joined to the first outlet port of said water inlet conduit and having an opposite end;

(c) A suction nozzle integral with the opposite end of said injector conduit, said suction nozzle having a suction end for intaking the slurry with the suction end defining a longitudinal axis and disposed at an acute angle with respect to the opposite end of said injector conduit, said suction nozzle also including an outlet end which extends from the suction end thereof for delivering the slurry intaken by the suction end to the ore separating structure with the outlet end being in axial alignment with the opposite end of said injector conduit;

(d) digging means at the suction end of said suction nozzle for burrowing into the soil, said digging means comprising a plurality of rods extending from the suction end of said suction nozzle and converging toward one another to form a point;

(e) a venturi restrictor in the opposite end of said injector conduit for producing a low pressure within the suction end of said suction nozzle for slurry intaking purposes;

(f) a puddling nozzle for ejecting at least some of the water received in said water inlet conduit and directing said water to a dry area in the vicinity of the suction end of said suction nozzle for producing the slurry, said puddling nozzle being mounted in the second outlet port of said water inlet conduit and defining a longitudinal axis that is convergent with the longitudinal axis of the suction end of said suction nozzle, said puddling nozzle having an outlet end located above the suction end of said suction nozzle;

(g) a deflection member mounted in the bore of said water inlet conduit and having a guide surface in spaced facing relation to the intake end thereof for directing incoming water toward the first outlet port of said water inlet conduit, said deflection member further defining a relief area in the bore of said water inlet conduit for allowing fluid communication with the second outlet port of said water inlet conduit; and (h) control means for switching said puddling nozzle from a bypass mode in which said puddling nozzle is closed to an operation mode in which said puddling nozzle is at least partially open.

2. The placer mining apparatus of claim 1, in which said control means comprises a manually operable valve demountably carried on said puddling nozzle.

3. The placer mining apparatus of claim 2, in which said manually operable valve comprises:

(a) a housing mounted on said puddling nozzle and defining an axial bore;

(b) an annular flange formed in the axial bore of said housing and defining a valve seat;

(c) a rotatable ball valve mounted in the axial bore of said housing in seated engagement with said annular flange, said ball having a bore formed therethrough;

(d) a stem formed on said ball valve and projecting from said housing;

(e) a knob on the projecting end of said stem for rotating said ball valve from an operative position in which said bore of said ball valve is aligned with the longitudinal axis of said puddling nozzle to a bypass position in which said bore of said ball valve is perpendicular to the longitudinal axis of said puddling nozzle; and (f) screw threads formed on said housing of said manually operable valve for allowing attachment of an accessory thereto.

* * * * *